US008770887B1

(12) United States Patent
Geier

(10) Patent No.: US 8,770,887 B1
(45) Date of Patent: Jul. 8, 2014

(54) VIBRATORY COMPACTING ROLLER MACHINE AND OPERATOR CONTROL THEREFOR

(71) Applicant: Wacker Neuson Production Americas LLC, Menomonee Falls, WI (US)

(72) Inventor: Daniel Geier, Colgate, WI (US)

(73) Assignee: Waacker Neuson Production Americas LLC, Menomonee Falls, WI (US)

( * ) Notice: Subject to any disclaimer, the term of this patent is extended or adjusted under 35 U.S.C. 154(b) by 0 days.

(21) Appl. No.: 13/745,181

(22) Filed: Jan. 18, 2013

(51) Int. Cl.
*E01C 19/38* (2006.01)
*H01H 3/00* (2006.01)
*E01C 19/28* (2006.01)

(52) U.S. Cl.
CPC ..... *H01H 3/00* (2013.01); *E01C 19/286* (2013.01)
USPC ..... 404/117; 74/473.3; 200/61.54

(58) Field of Classification Search
CPC ..... H01H 3/00; E01C 19/286
USPC ..... 404/103, 104, 113, 117, 121–128, 132; 74/469, 473.19, 473.33, 473.3; 200/61.54
See application file for complete search history.

(56) References Cited

U.S. PATENT DOCUMENTS 3,309,972 A * 3/1967 Peters ..... 404/117
3,814,532 A * 6/1974 Barrett et al. ..... 404/117
3,909,147 A * 9/1975 Takata ..... 404/117
4,187,036 A * 2/1980 Haker et al. ..... 404/117
4,793,735 A * 12/1988 Paukert ..... 404/126
H0001831 H * 2/2000 Kelley et al. ..... 180/333
6,431,790 B1 * 8/2002 Anderegg et al. ..... 404/75
6,769,838 B2 * 8/2004 Potts ..... 404/117
6,948,398 B2 * 9/2005 Dybro ..... 74/471 XY
7,511,236 B2 * 3/2009 Mack ..... 200/61.54
8,069,927 B2 * 12/2011 Bachstein et al. ..... 172/431
8,328,464 B2 * 12/2012 Sina et al. ..... 404/117
8,380,402 B2 * 2/2013 Hobenshield ..... 701/50
8,392,049 B2 * 3/2013 Goodwin et al. ..... 701/29.1
8,439,598 B2 * 5/2013 Norton ..... 404/75
2005/0211449 A1 * 9/2005 Bares et al. ..... 172/2
2009/0169300 A1 * 7/2009 Allen et al. ..... 404/112
2010/0014917 A1 * 1/2010 Willis et al. ..... 404/93
2011/0229264 A1 * 9/2011 Weiser ..... 404/72
2012/0152575 A1 * 6/2012 Hand et al. ..... 172/812
2013/0180744 A1 * 7/2013 Favreau et al. ..... 172/780
2013/0317695 A1 * 11/2013 Kontz et al. ..... 701/33.1

* cited by examiner

*Primary Examiner* — Raymond W Addie
(74) *Attorney, Agent, or Firm* — Boyle Fredrickson, S.C.

(57) ABSTRACT

A vibratory ride-on roller machine includes a chassis supported on front and rear vibrating drum assemblies that compact the surface on which the machine travels. The machine is controlled via a control assembly including a control lever. A number of control elements for controlling operations of the roller machine are located on the control lever, the operations including one or more of turning the exciter assembly on and off, switching between exciter assemblies, controlling the level of vibration of the exciter assemblies, controlling a spray assembly, and sounding a horn element. The control elements are advantageously positioned to enable operator actuation regardless of the operator's orientation on the roller and regardless of the position of the control lever within its operating stroke.

19 Claims, 10 Drawing Sheets

VIBRATORY COMPACTING ROLLER MACHINE AND OPERATOR CONTROL THEREFOR

BACKGROUND OF THE INVENTION

1. Field of the Invention

The invention generally relates to a vibratory compactor used, e.g., to compact asphalt or soil, and more particularly, relates to a ride-on vibratory compactor of the above-mentioned type having a multi-function control lever.

2. Discussion of the Related Art

Vibratory compactors are used in a variety of soil and asphalt compaction and leveling applications. Most vibratory compactors have plates or rollers that rest on the surface to be compacted that are excited to vibrate so as to compact and level the worked surface. A common vibratory compactor, and one to which the invention is well-suited, is a so-called "double drum roller" used to compact asphalt or soil.

The double drum roller includes a chassis supported on the surface to be compacted by two (front and rear) rotating drum assemblies, each of which may support a respective subframe of the chassis. Each of the drum assemblies is driven to rotate by a dedicated hydraulic motor. Both hydraulic motors are supplied with pressurized hydraulic fluid from a pump powered by an internal combustion engine mounted on one of the subframes. In addition, each drum assembly is excited to vibrate by a dedicated exciter assembly that is located within the associated drum assembly and is powered by a hydraulic motor connected to a pump. Each exciter assembly typically comprises one or more eccentric masses mounted on a rotatable shaft that is positioned within the drum assembly. Rotation of the eccentric shaft imparts vibrations to the remainder of the drum assembly.

An operator support platform is typically situated on the subframe of the chassis and provides an operator's seat for supporting the operator of the roller. A control assembly for operating travel and operations of the roller is typically located near the operator and may include a steering wheel for controlling directional steering and a control lever for controlling forward and rearward travel by selective movement of the control lever in the forward and rearward directions, respectively. The control lever is typically cable-operated and has a relatively long stroke length between its forward-most and rearward-most positions. During operation, the operator of the roller typically maintains one hand on the steering wheel for steering and the other hand on the control lever to control forward and backward travel.

The control assembly further includes a number of control elements, e.g., buttons, switches, knobs, and the like located on the dash of the roller and configured to be selected for carrying out a multitude of functions of the roller. For instance, the control elements are provided to control the activation and deactivation of the vibratory exciter assemblies, switching between which of the vibratory exciter assemblies is active, controlling the level of vibration, e.g., high and low, operating a spray assembly configured to spray the drum with water, and sounding a horn element to alert individuals to the presence of the roller.

Ride-on rollers are typically used in a cyclical manner, i.e. driving back and forth over a section of soil or asphalt to compact the surface. The cyclical operation of the machine requires a high duty cycle on the control lever. Further, it is often desired to switch between the front and rear vibratory exciters when switching between the forward and rearward movement and vice versa to maximize vibration in the lead drum assembly, i.e., the front drum assembly in the forward direction and rear drum assembly in the rearward direction. The high duty cycle with respect to forward and backward travel and actuation of the lead vibratory exciter results in the operator of the roller repeatedly switching between a forward-facing position for forward travel and rearward-facing position for rearward travel.

The high duty cycle of the control lever for forward and rearward movement and for switching between the lead vibratory exciters hinders roller control because the operator must remove his or her hand from the control lever or steering wheel to actuate the control elements located on the dash. Thus, the operator must repeatedly move his or her hand between the control lever or steering wheel and the controls on the dash, which limits the operator's ability to control movement of the roller. Moreover, when moving in reverse, this process is made even more difficult because the operator must blindly remove his or her hand from the control lever or steering wheel, search for the appropriate control element on the dash, and return his or her hand to the control lever or steering wheel while the roller is in motion. In the alternative, the operator may take his or her eyes off the direction of travel to find the appropriate control element, which is understandably inherently dangerous to the operator as well as others in the area.

While some known ride-on vibratory rollers include a control element on the control lever for turning the exciter assemblies on and off, the rest of the control elements are located on the dash. The operator of such a ride-on vibratory roller still must remove his or her hand from the control lever and/or steering wheel repeatedly to control the various other functions of the roller and most notably to switch between which of the exciter assemblies is activated to correspond to a direction of travel so the lead exciter assembly's vibratory impact on the work surface is maximized.

The need therefore exists to provide a control assembly and control method for a vibratory ride-on roller of the like that eliminates one or more of the foregoing disadvantages.

SUMMARY OF THE INVENTION

In accordance with a first aspect of the invention, at least one of the above-identified needs is met by providing a ride-on vibratory roller machine supported on front and rear drum assemblies. The drum assemblies include respective exciter assemblies for imparting vibrations to the respective drum assemblies. An operator's seat is supported on the chassis. A control lever, positioned beside the operator's seat, is operably coupled with the vibratory roller and configured to control forward and rearward travel of the vibratory roller by selective movement of the control lever in a forward and rearward direction, respectively.

A number of control elements, e.g., switches, configured for selective actuation to control a number of features of the vibratory ride-on roller, are located on the control lever. The control elements preferably are positioned to be selectable by the operator during movement of the control lever between a maximum forward position and a maximum rearward position of the control lever. At least some of these control elements, and preferably those having the highest duty cycle, preferably are accessible by the thumb of an operator regardless of whether the operator is facing forwardly or rearwardly and regardless of the position of the control lever within its operating stroke.

The control elements preferably include at least a first control element for selectively turning the exciter assemblies on or off and a second control element for switching between activation of the front, rear, or both exciter assemblies. The first and second control elements may be in the form of switches provided on an inboard surface of a handle of the control lever configured for actuation by a thumb of the operator. The second control element may be a toggle switch comprising front and rear toggle elements configured to be selectively depressible between a first position in which the front toggle element is depressed to activate he front exciter assembly, a second position in which the rear toggle element is depressed to activate the rear exciter assembly, and a third, intermediate position in which both the front and rear exciter assemblies are activated.

A third control element, also located on the control lever, may be provided to switch the then-active exciter assembly or assemblies between a high and low setting. The third control element may be provided on an inboard end of the handle of the control lever for selective actuation by the thumb of the operator.

Another control element, also provided on the control lever, may be configured to selectively operate a spray assembly for wetting the surface to be compacted by the ride-on vibratory roller. This element may be situated on a front surface of the handle of the control lever.

Another control element, also provided on the control lever, may be configured to selectively sound an audible horn element to alert individuals in the area to the presence of the ride-on vibratory roller. This control element may be located on a rear surface of the handle of the control element.

A method of operating a vibratory compaction ride-on roller according to the present invention is also disclosed herein.

Various other features, embodiments and alternatives of the present invention will be made apparent from the following detailed description taken together with the accompanying drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

Figure 1:
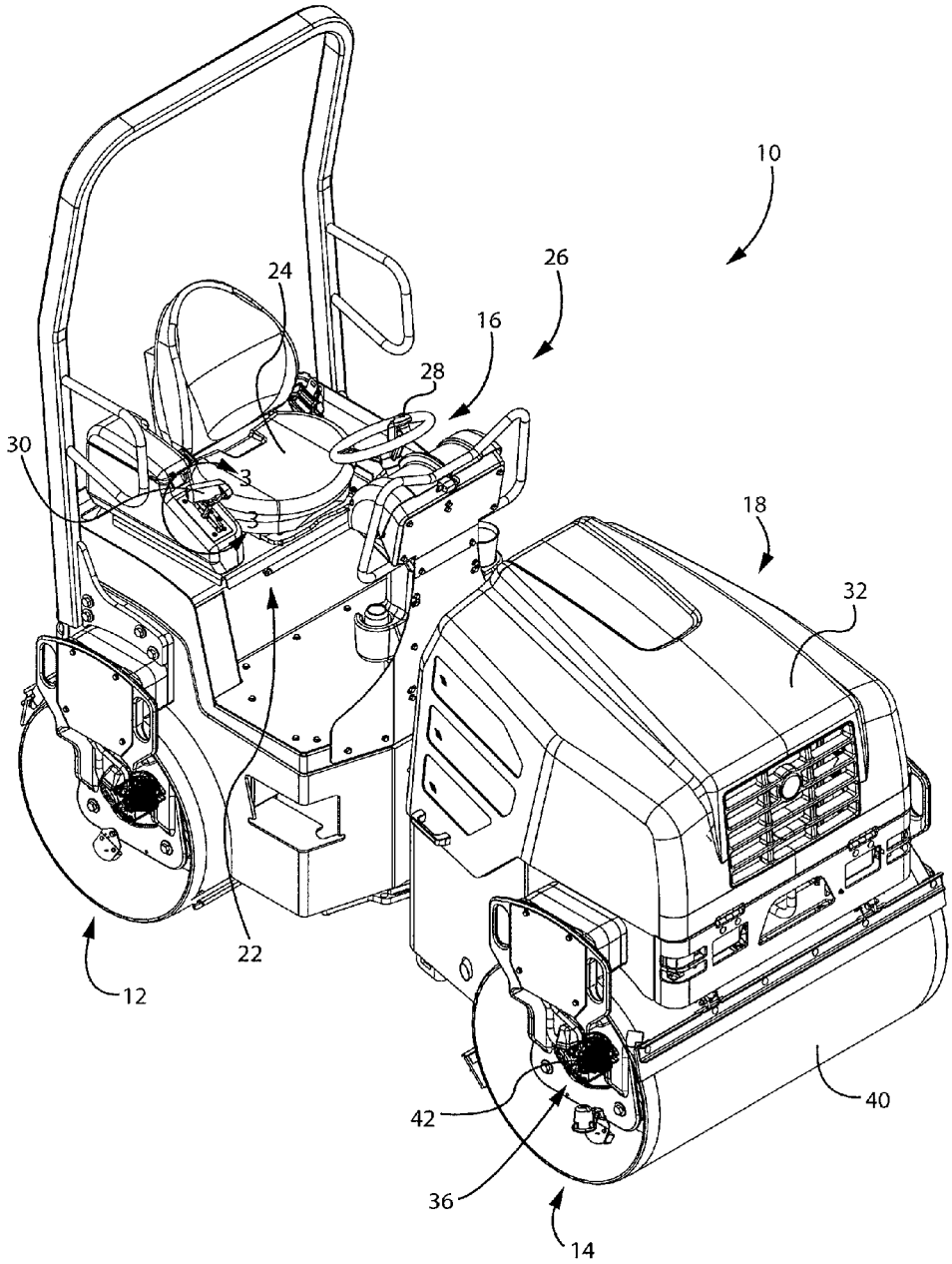
FIG. 1 is an isometric view of a ride-on vibratory roller machine having an operator control assembly according to an embodiment of the present invention.
Figure 2:
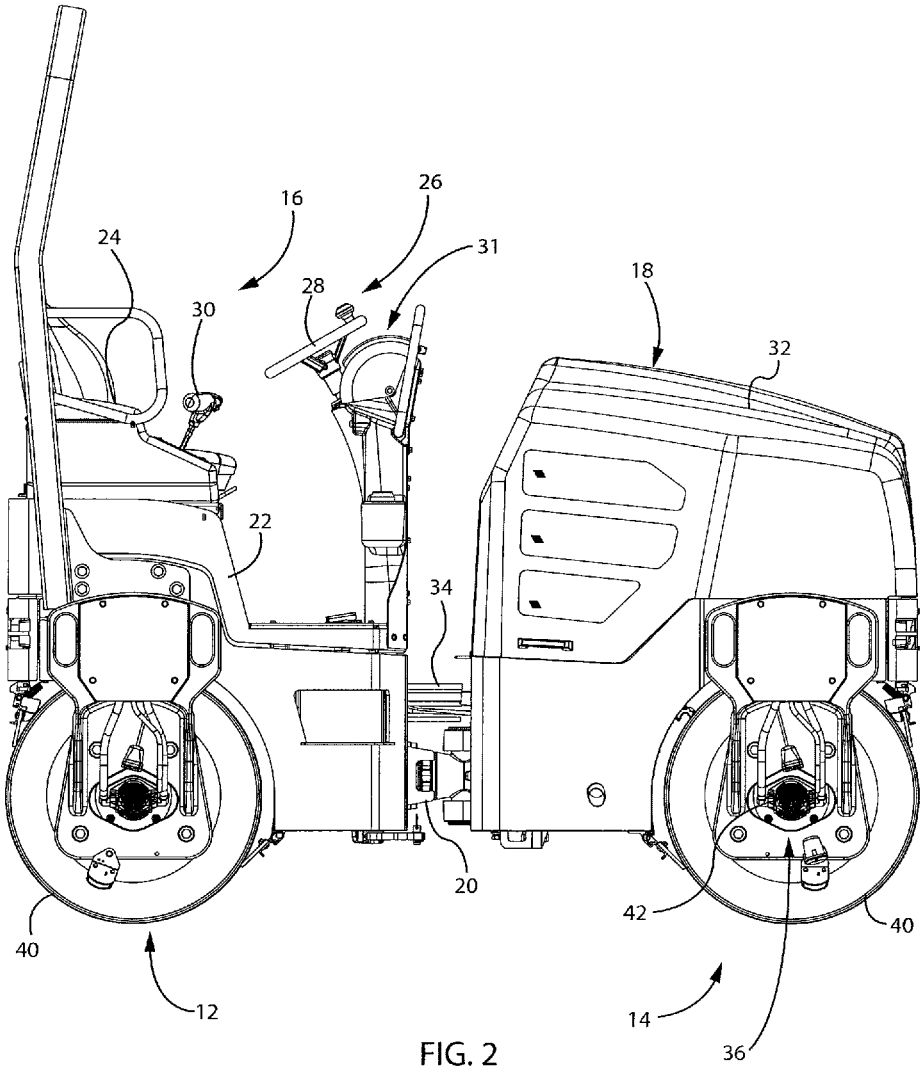
FIG. 2 is a side elevation view of the machine of FIG. 1.

Referring now to the drawings, and initially to FIGS. 1 and 2, a vibratory roller 10 (alternatively, machine 10) is illustrated in accordance with a preferred but exemplary embodiment of the invention. The roller 10 is a so-called double drum roller comprising a self-propelled machine supported on the ground via rear and front rotating drum assemblies 12 and 14, respectively. The roller 10 may be the kind used to compact soil to provide a firm foundation for paving or to reduce the future settlement of soil. The roller 10 may also be utilized for compacting and smoothing asphalt to provide a durable surface to accommodate increased traffic and travel.

The roller 10 comprises an articulated chassis having rear and front subframes 16 and 18 connected to one another via a pivot connection 20. The rear subframe 16 includes an operator support platform 22 including an operator's seat 24 positioned to enable an operator to selectively operate a control assembly 26. The seat 24 of this embodiment is mounted over the rear drum assembly 12, but could be located elsewhere on the machine 10. The control assembly 26 of this embodiment includes a steering wheel 28 and a control lever 30. Additional controls and/or indicators (not shown) may be mounted on the dashboard 31 in front of and/or to either side of the steering wheel 28. The front subframe 18 supports an engine (not shown) accessible via a ventilated hood 32. The control assembly 26 of the roller 10 according to this embodiment is operably coupled with the drive assembly of the roller 10 in a manner generally understood in the art to direct forward and backward movement of the roller 10 via the control lever 30 and to turn the roller 10 via the steering wheel 28.

The roller 10 may be steered by an actuator shown here as a linear actuator 34 extending between the rear and front subframes 16 and 18 along a line that is offset from the center of the pivot axis of the articulated subframes 16 and 18. Movement of the linear actuator 34 causes the subframes 16 and 18 to pivot relative to one another, thereby steering the roller 10 as the front and rear drum assemblies 12 and 14 are individually driven. The linear actuator 34 may be driven by way of a solenoid or other similar element known in the art. Alternatively, the linear actuator 34 may be actuated hydraulically.

As is generally understood in the art, each drum assembly 12 and 14 is excited to vibrate by a dedicated exciter assembly 80 and 82, respectively (see FIG. 10), that is located within the associated drum assembly and that is powered by a drive system. Each exciter assembly typically comprises one or more eccentric masses (not shown) mounted on a rotatable shaft(s) (not shown) positioned within drum assembly 12 or 14. Rotation of the eccentric shaft imparts vibrations to the corresponding drum assembly. In this way, the drum assemblies 12 and 14 are operable to compact the surface on which the machine 10 rests. Operation of the dedicated exciter assemblies may be carried out via one or more control elements situated on the control lever 30 as will be described in additional detail herein.

The construction and operation of the front drum assembly 14 will now be described with reference to FIG. 1, it being understood that the description applies equally to the rear drum assembly 12. The front drum assembly 14 includes an axle housing 36 and a drum 40 that surrounds the axle housing 36 and that is mounted on the axle housing 36 by a driven axle 42. The axle housing 36 is a cast metal housing that is generally tubular in shape and has open ends (not shown). The axle housing 36 additionally includes a mounting frame that extends longitudinally of the machine 10 and that is connected to the front subframe 18 of the machine by a number of mounts (not shown). The drum 40 extends laterally beyond the ends of the axle housing 36 by an amount that determines the compaction width of the machine 10. In the illustrated embodiment in which the machine 10 is configured to compact a 47.2" (1200 mm) wide strip, each end of the drum 40 protrudes beyond the associated sub-frame 16 or 18 by several inches. Significantly longer and shorter drums and correspondingly wider and narrower compaction widths also are well within the scope of the present invention.

One or both of the front and rear subframes 16 and 18 additionally includes a spray assembly 44(see FIG. 10) configured to spray water onto the associated drum assembly 12, 14. The spray assembly 44 may include a reservoir (not shown) for holding water to be delivered by the spray assembly. The reservoir may be operably connected by a pump (not shown) to a nozzle (not shown) or similar delivery element by way of tubing or a similar connector. Operation of the spray assembly 44 may be carried out by way of a control element situated on the control lever 30 as will be described in additional detail herein.

The roller 10 of the present invention may also include a device for presenting a warning to nearby persons such as a horn 84 (see FIG. 10) that may be selectively actuated by the operator. The horn 84 may be actuated via a control element situated on the control lever 30, operation of which will be described in detail hereinafter.

With additional reference now to FIGS. 3-9, the control lever 30 of the control assembly 26 is shown in additional detail and is generally configured to enable operator actuation of a number of the aforementioned components of the roller 10 such as the exciter assemblies 80 and 82, forward and rear travel, the spray assembly 44 and the horn element 84. The control lever 30 is provided on the operator's platform 22 beside the seat 24 within a comfortable reaching distance so that a seated operator may grasp the control lever 30 in his or her right hand while controlling the steering wheel 28 with his or her left hand. "Beside" in this regard should be understood to mean to one side of the seat 24 (in this case the right side) within arm's reach of a seated operator. The center position of the control lever 30 could be located on, in front of, or behind a line extending laterally through a front portion of the seat 24. Understandably, positioning of the control lever 30 to the opposing (left) side of the seat 24 is within the scope of the invention. Moreover, the control lever 30 preferably is positioned to be within a comfortable reaching distance from the seated operator when located in either of the forward, backward, and neutral control lever positions as will be described.

With continued reference to FIG. 3-10, the control lever 30 is configured to be selectively moved by the operator within an elongate slot 46 formed in a mounting plate 48 coupled to a pedestal 51 by a number of fasteners 50. The mounting plate 48 may include indicia indicating the drive directions, e.g., forward, rearward, and neutral and magnitude thereof. The control lever 30 includes a handle 52 generally shaped and sized for grasping by the seated operator so that the operator's thumb is received over an inboard end 56 of the handle 52 while the operator's other fingers are received over the top 58 and front end 60 thereof while the operator's palm rests on a opposite the inboard end 56, is generally canted rearwardly relative to the inboard end 56 so as to extend at an acute angle relative to a plane that laterally bisects the support arm and so as to extend at an acute angle relative to a horizontal plane, thus providing a comfortable grasping surface for the operator's fingers and to ensure the operator's thumb is appropriately positioned for controlling the various control elements situated on the control lever 30. As will be described in additional detail hereinafter, by positioning the seated operator's hand in this manner, control of the various functions of the roller 10 is made easier and safer regardless of the control lever 30 position along the stroke length thereof.

Figure 3:
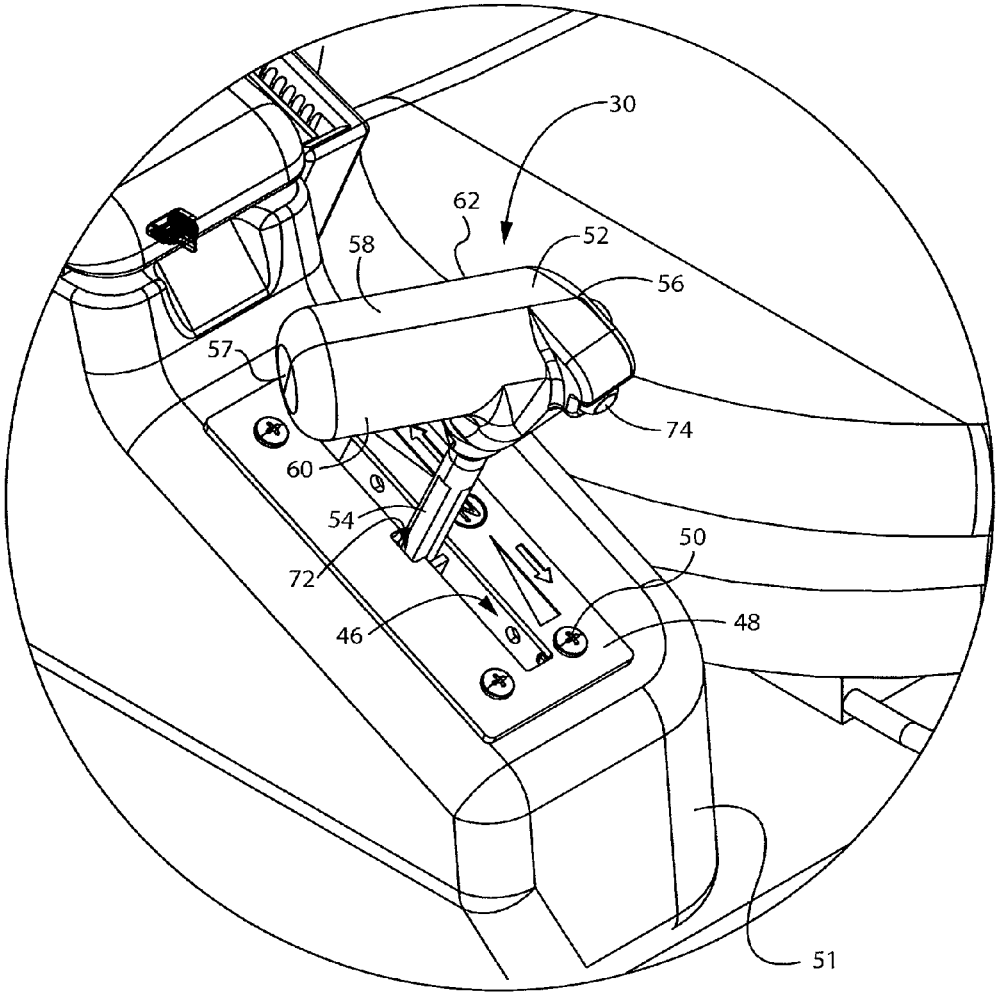
FIG. 3 is a partial isometric view of a control lever of the operator control assembly according to the present invention taken along line 3-3 of FIG. 1.
Figure 4:
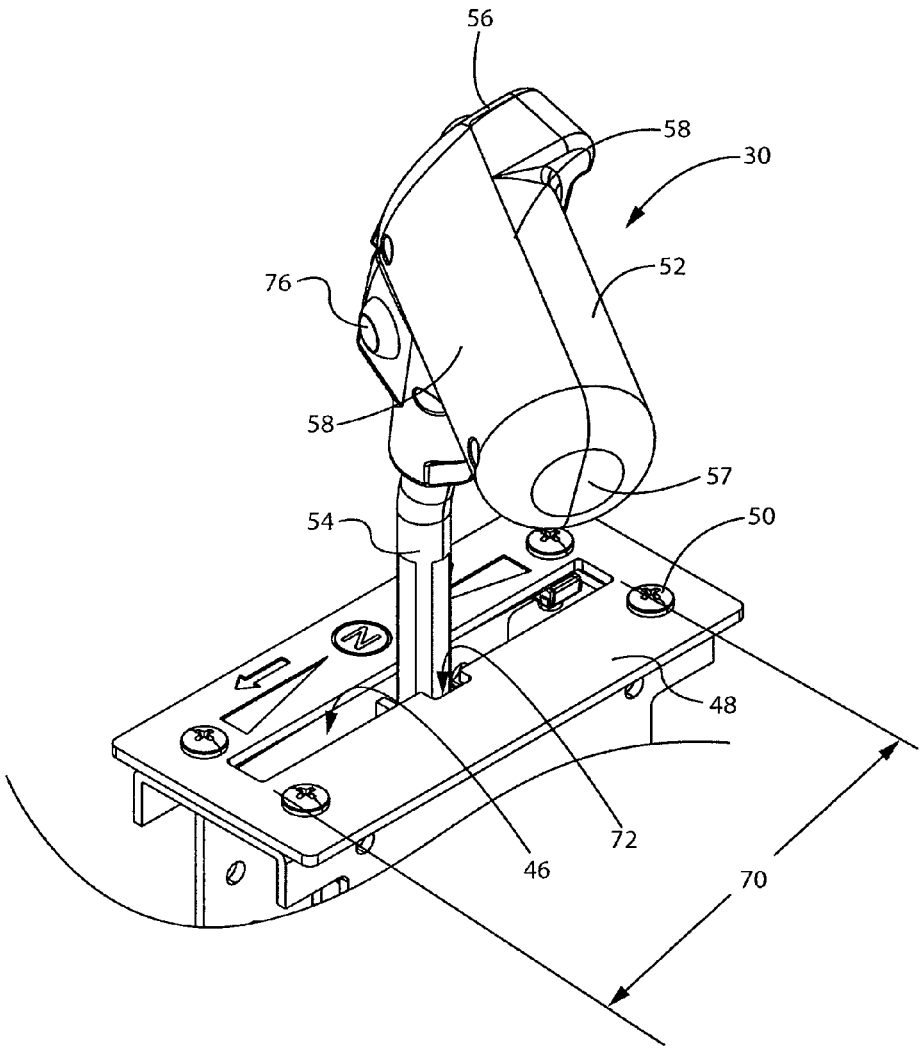
FIG. 4 is an isometric view of the control lever of FIG. 3.
Figure 5:
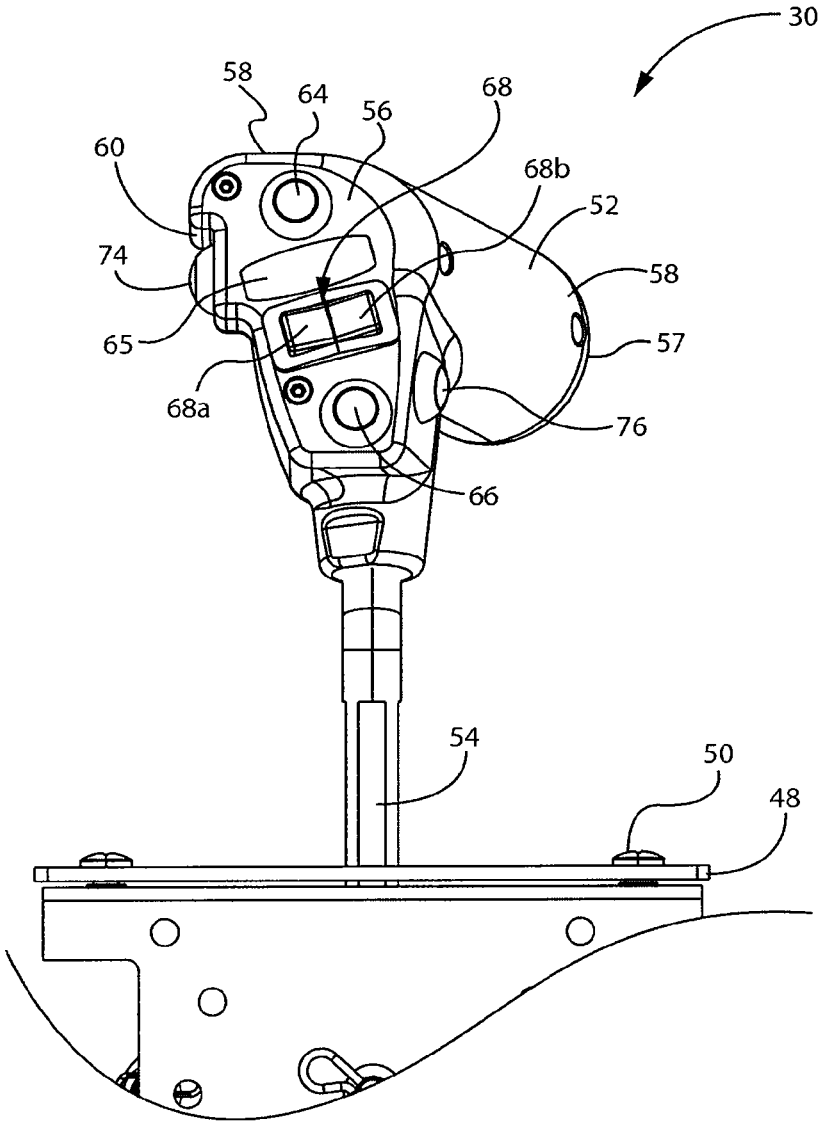
FIG. 5 is a side elevation view of the control lever of FIG. 3.
Figure 6:
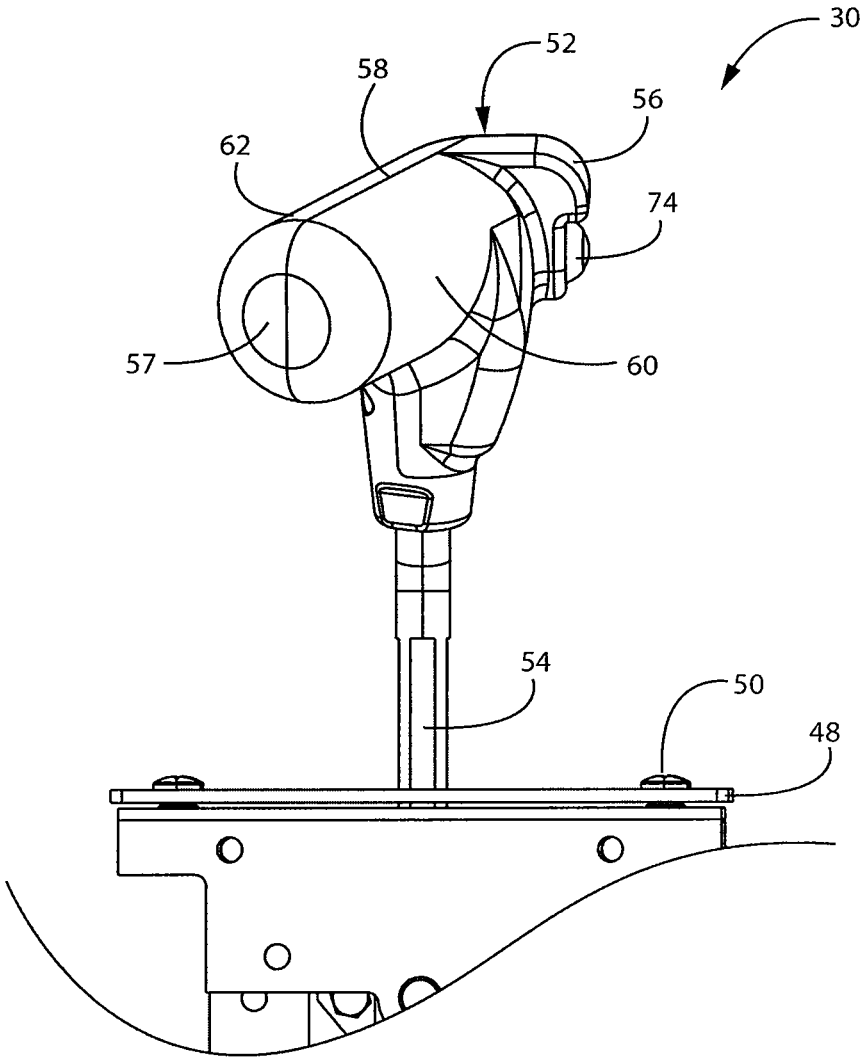
FIG. 6 is an opposite side elevation view of the control lever of FIG. 3.
Figure 7:
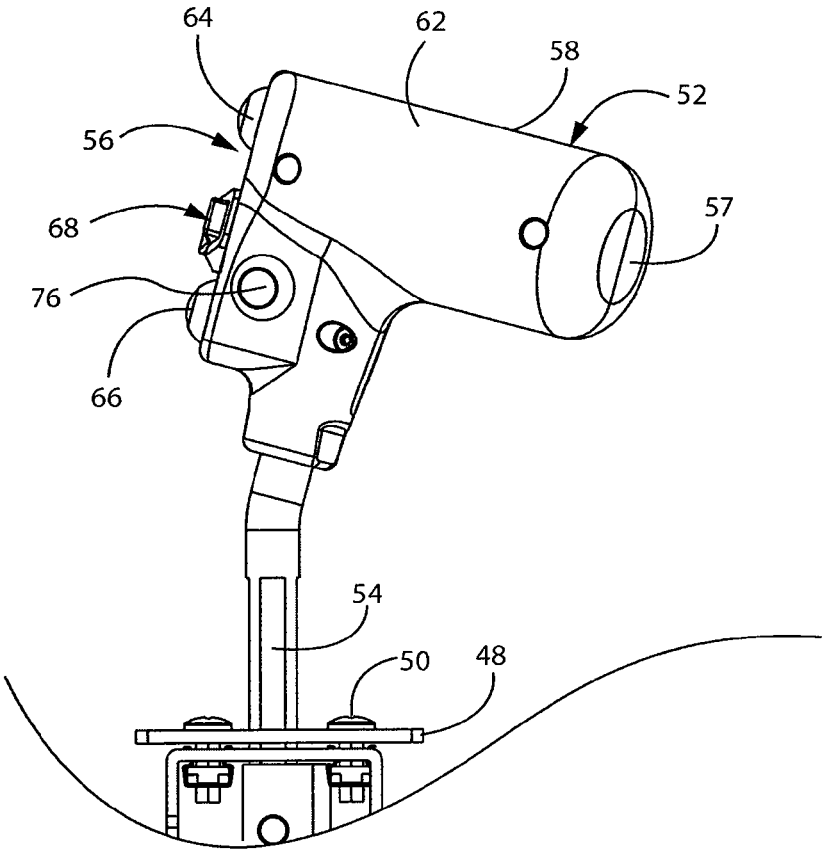
FIG. 7 is a rear elevation view of the control lever of FIG. 3.
Figure 8:
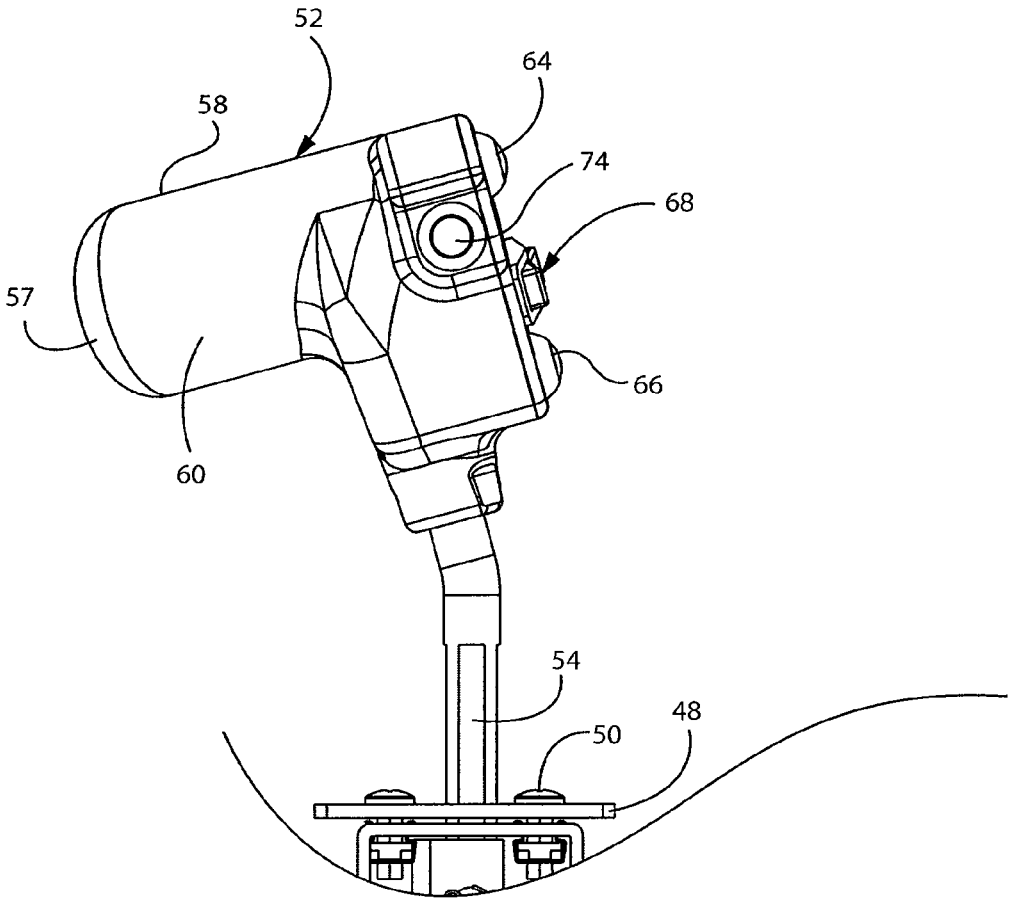
FIG. 8 is a front elevation view of the control lever of FIG. 3.
Figure 9:
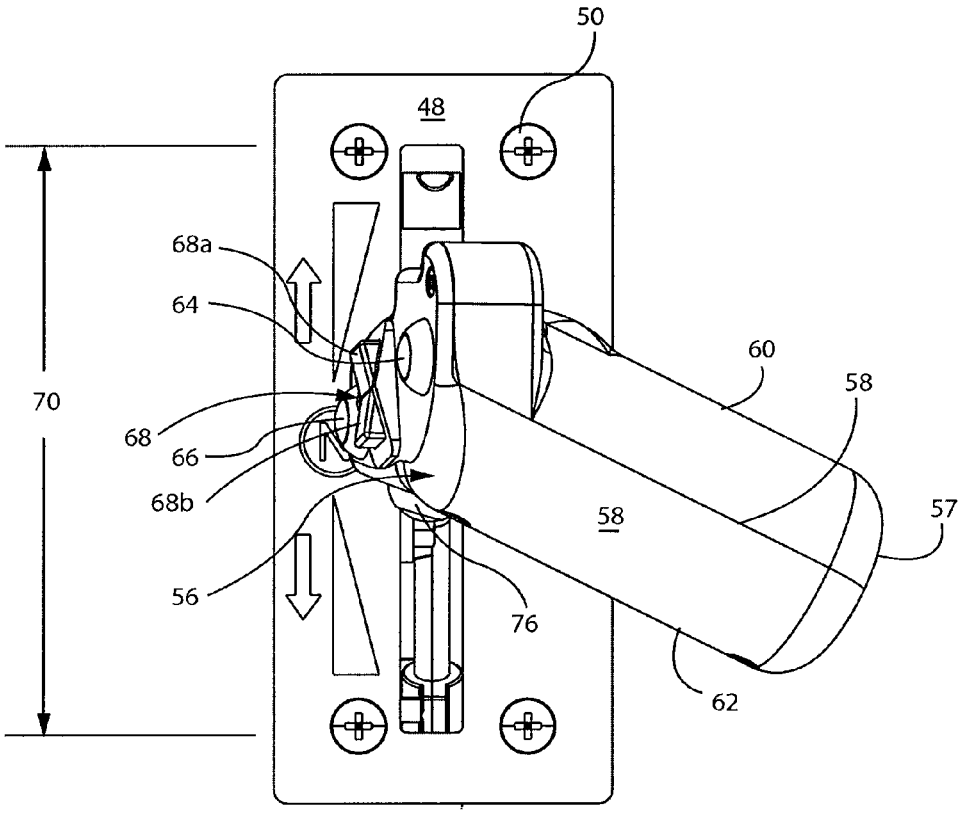
FIG. 9 is a top plan view of the control lever of FIG. 3.

As shown in FIG. 3, the control lever 30 may be received within a notch 72 formed in the slot 46 and configured to correspond to a neutral drive operation of the roller 10. The operator may selectively direct movement of the roller 10 in the forward or backward direction by moving the control lever 30 either forward or backward, respectively. The roller 10 may be configured to be selectively positionable at any point along the length of the slot 46 to thereby control the magnitude, i.e., speed, of the forward and backward travel. That is, the further forward, relative to neutral, the control lever 30 is positioned within the slot 46, the faster the forward travel; and the further backward, relative to neutral, the control lever 30 is positioned within the slot 46, the faster the backward travel. In this manner, the operator may control the direction and speed of travel through simple manipulation of the position of the control lever 30 while maintaining directional steering of the roller 10 via the steering wheel 28.

With particular reference now to FIGS. 5 and 7-9, the control lever 30 includes a number of control elements for controlling operation of the exciter assemblies 80 and 82 in the form of first and second exciter switches 64 and 66 and exciter toggle switch 68 situated on the inboard end 56 of the control lever 30 to thereby be positioned for actuation by the operator's thumb during operation of the roller 10. The first exciter switch 64 is provided near the top 58 of the control lever 30 and the second exciter switch is provided near a bottom of the control lever 30. The exciter toggle switch 68 is disposed between the first and second exciter switches 64 and 66, respectively and is generally configured to enable the seated operator to position his or her thumb over the exciter toggle switch 68 during operation for easily moving between the first and second exciter switches 64 and 66 respectively. The first and second exciter switches 64 and 66 are operably coupled to the front and rear exciter assemblies 80 and 82 and are configured to turn vibration of the exciter assemblies 80 and 82 on and off and to switch between high and low vibration settings, respectively. However, it is understood that either of the first and second exciter switches 64 and 66 may be configured to carry out either of the aforementioned operations.

The exciter toggle switch 68 likewise is operably coupled with the front and rear exciter assemblies 80 and 82 and configured to be positioned in one of three different configurations to control, which of the exciter assemblies 80 and 82 is to be controlled by actuation of the first and second exciter switches 64 and 66. In particular, the exciter switch 68 is configured so the front exciter assembly 80 is activated when the forward toggle element **68*a* is depressed and the rear exciter assembly 82 is activated when the rear toggle element 68*b* is depressed. For control of both the exciter assemblies 80 and 82, the exciter switch 68 may be configured to be in its neutral position in which neither the forward or rear toggle element 68*a* and 68*b*, respectively, is depressed. In this way, the operator may simultaneously control both of the exciter assemblies 80 and 82 and does not have to switch back and forth between the two. The exciter switch 68 is intuitively constructed to correspond with the operator's expectations. That is, the forward toggle element 68*a* controls the front exciter assembly 80, while the rear toggle element 68*b* controls the rear exciter assembly 82, and both of the exciter assemblies 80 and 82 are operated when the exciter switch 68 is in its center position. In this manner, the operator may safely and simply switch between the front, rear, and both exciter assemblies 80 and 82 during operation without having to remove his or her hand from the control lever 30 or the steering wheel 28** and without taking his or her eyes off the direction of travel to locate the correct control element.

As may be readily understood, during operation of the roller 10, the operator seated in seat 24 is continually moving the control lever 30 in the forward and rearward directions to carry out the rolling operation to be performed while also correspondingly activating the front and rear exciter assemblies 80 and 82. Accordingly, the first and second exciter switches 64 and 66 and exciter toggle switch 68 experience relatively high duty cycles. Operating at a high duty cycle is facilitated by positioning the switches at a location on the control lever 30 in which the operator may quickly, easily, and without visual reference thereto, actuate the appropriate switches of the control lever 30 for controlling operation of the exciter assemblies 80 and 82 as he moves the lever 30 back and forth. Moreover, the control lever 30 can have a relatively long stroke length, represented as numeral 70 in FIGS. 4 and 9, typically on the order of approximately twelve inches. The first and second exciter switches 64 and 66 and exciter switch 68 are advantageously positioned to enable the operator to quickly, easily, and without visual reference thereto, actuate the appropriate control for carrying out the desired activity regardless of where the control lever 30 is positioned along the stroke length 70. In the illustrated example, the switches 64 and 66 are located above and below a location 65 where the operator can conveniently rest his or her right thumb when no switches are activated.

As a consequence of the high duty cycle on the forward and rearward movement of the control lever 30, the operator ideally would like to have his or her hand on the control lever 30 at all times. The vibration controls for the exciter assemblies 80 and 82 also have a high duty cycle. That is, the operator typically switches between front vibration to rear vibration when going from forward to reverse travel and vice versa. Accordingly, in positioning the first and second exciter switches 64 and 66 and exciter toggle switch 68 on the control lever 30 instead of on the dash of the control assembly 26 as is common, the control assembly 26 is more easily and safely operable. Further, when the roller 10 is driven rearwardly, the operator typically is facing, at least partially, rearwardly making actuation of controls on the dash inconvenient as actuation thereof requires the user to turn away from the direction of travel while also removing his or her hand from the control lever 30. In addition, the manner in which the first and second exciter switches and the exciter switch 68 are situated is additionally particularly advantageous. In particular, the operator's thumb is naturally received over the inboard 56 of the control lever 30 in a manner conducive to positioning the high duty cycle controls of the roller 10 nearby. Moreover, the thumb is particularly adept at moving between a number of spaced elements such as the first and second exciter switches 64 and 66 and the exciter toggle switch 68 in a relatively easy manner due to the opposable nature of the thumb, which enables grasping of the control lever 30 while simultaneously enabling movement of the thumb between the first and second exciter switches 64 and 66 and the exciter toggle switch 68.

The spray assembly 44 (FIG. 10) is typically used during asphalt rolling operations. During the course of rolling the asphalt or other surface, the spray assembly 44 is in operation and applying water to the drum 40. However, on occasion, the operator will be required to leave the work surface with the roller 10, and it is desirous to turn the spray assembly 44 off to conserve water. Accordingly, the operator may actuate a spray assembly switch 74 to turn the spray assembly 44 off when the roller 10 is off the work surface and then actuate the spray assembly switch 74 to turn the spray assembly 44 back on when the roller 10 returns to the work surface. Understandably, the operator may desire to turn the spray assembly on or off for any number of other reasons and may simply do so via actuation of the spray assembly switch 74.

Figure 10:
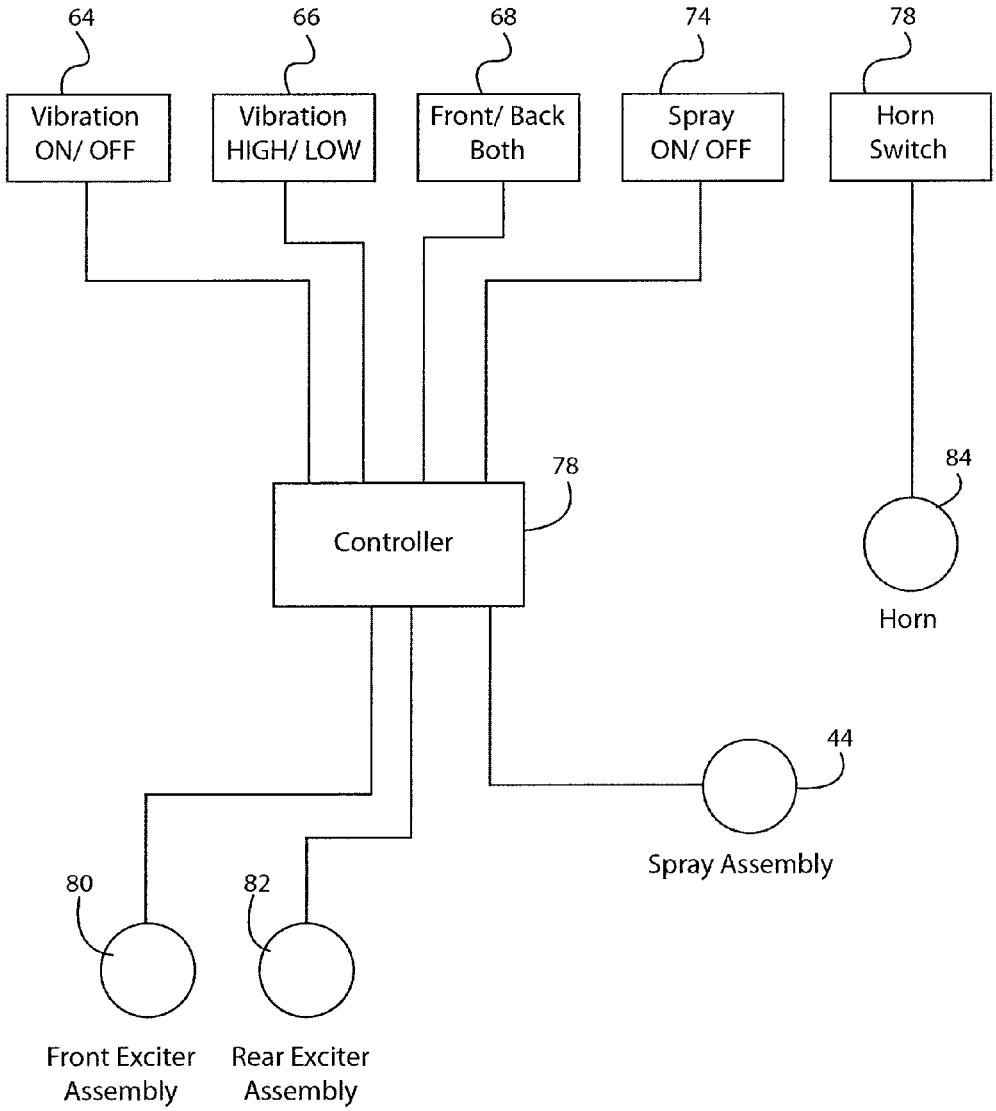
FIG. 10 is a schematic diagram of the control assembly of present invention.

With particular reference now to FIGS. 3, 5, 6, and 8, the spray assembly switch 74 is situated on the front of the control lever 30 and is configured for controlling operation of the spray assembly 44 (see FIG. 10). The spray assembly switch 74 is advantageously positioned to enable the operator to selectively actuate the spray assembly switch 74 to control on and off operation of the spray assembly regardless of the position along the stroke length 70 of the control lever 30. In particular, the spray assembly switch 74 is configured to enable the operator to actuate the spray assembly switch 74 using his or her index finger, which may be received over the front of the handle 52 of the control lever 30 in a comfortable, ergonomic manner. The spray assembly switch 74 may be located at a position relative to a vertical axis between the first exciter switch 64 and the toggle exciter switch 68 for actuation by the operator with his or her index finger while the operator's thumb is positioned over the inboard end 56 of the control lever 30.Again, as with the exciter assembly switches 64 and 66 and switch 68, the spray assembly switch 74 is positioned so as to be easily accessible to the operator independent of the direction of travel of the roller 10, and more particularly, independent of whether the operator is facing forward during forward travel or rearward for rearward travel. In another embodiment of the invention, the control lever 30 may include one or more additional switches (not shown) for controlling the volume of liquid delivered by the spray assembly 44.

In yet another embodiment, the control lever 30 may include one or more additional switches (not shown) for separate control of a front, rear or both spray assemblies 44.

With particular reference now to FIGS. 4, 5, 7, and 9, a horn switch 76 is situated on the rear end 62 of the control lever 30. The horn switch 76 is configured to be selectively actuated by the operator to alert individuals nearby of the presence of the roller 10 in the area. The horn switch 76 typically has a lower duty cycle than other functions carried out by the operator, but nonetheless, it is desirous to provide the horn switch 76 at an easily accessible position so the operator need not remove his or her land from the control lever 30 or steering wheel 28. The horn switch 76 may be generally vertically aligned relative to the second exciter switch 66 or generally near the bottom of the control lever 30.

The relative locations of the first and second exciter switches 64 and 66, exciter toggle switch 68, spray assembly switch 74, and horn switch 76 serve to provide the operator of the roller 10 with a convenient mechanism in which to carry out the various functions of the roller 10 without having to remove the operator's hand from either the steering wheel 28 or the control lever 30 as is common in known roller designs. The control lever 30 is preferably cable-operated and, as previously indicated, experiences a relatively long stroke length 70 of approximately twelve inches. Because of the long stroke of the control lever 30, it is desirous to provide each of the controls for carrying out the functions of the roller 10 so the operator may easily actuate each of the controls regardless of where the control lever 30 is positioned along the stroke length. That is, the layout of the controls of the control lever 30 is such that regardless of whether the control lever 30 is at its forward-most position, rearward-most position, or any point therebetween, the operator may easily actuate each of the controls for carrying out the functions of the roller 10 without removing the operator's hand from either the steering wheel 28 or the control lever 30. Thus, the controls with a relatively high duty cycle, i.e., the first and second exciter switches 64 and 66 and the exciter toggle switch 68, are positioned so the operator's thumb will be naturally positioned nearby so the operator may easily repeatedly turn the exciter assemblies 80 and 82 on and off, switch between high and low vibration of the selected exciter assembly 80 or 82, and switch between activating the front, rear, or both exciter assemblies 80 and 82. Those controls with lower duty cycles, i.e., the spray assembly switch 74 and the horn switch 76, are located on the front and rear portions of the control lever 30, respectively, whereby they still may be easily actuated by the operator's index finger and thumb, respectively, while not interfering with the operator's forward and rearward movement of the control lever 30 and actuation of the switches 64, 66, and 68.

With additional reference now to FIG. 10, a schematic diagram of the operations of the control assembly 26 is provided. The first and second exciter switches 64 and 66 and exciter toggle switch 68 are operably coupled with a controller 78 configured to control operation of the front and rear exciter assemblies 80 and 82, respectively. The controller 78 receives input from each of the first and second exciter switches 64 and 66 and exciter toggle switch 68 and, thereby, controls operation of the front and rear exciter assemblies 80 and 82 accordingly. In particular, when the vibration of the front and rear exciter assemblies 80 and 82 is turned off, depressing the first exciter switch 64 activates vibration of the front and/or rear exciter assemblies 80 and 82 is turned on dependent upon the position of the exciter toggle switch 68. That is, if the front switch 68*a* is depressed, depressing the first exciter switch 64 will activate the front vibration assembly 82, if the rear switch 68*b* is depressed, depressing the first exciter switch 64 will activate the rear vibration assembly 80, and if neither the front and rear switch 68*a* and 68*b* are depressed, depressing the first exciter switch 64 will activate both the front and rear vibration assemblies 80 and 82. Once the front and/or rear vibration assemblies 80 and 82 have been activated by depressing the first exciter switch 64, actuation of the second exciter switch 66 will switch the vibration intensity of the selected vibration assembly 80 and 82 between a high and low vibration setting. The control assembly 26 may be configured so the vibration assemblies 80 and 82 default to a low vibration setting or high vibration setting as may be desired.

The spray assembly switch 74 is coupled with the spray assembly 44 of the roller 10 and configured to turn the spray assembly 44 on and off as desired. The spray assembly switch 74 is in communication with the controller 78, which relays signals received from the spray assembly switch 74 to the spray assembly 44 for controlling operation thereof The spray assembly 44 is turned on and off by depressing the spray assembly switch 74 so that, when the spray assembly 44 is turned on, depressing the spray assembly switch 74 turns the spray assembly 44 off and vice versa.

The horn switch 76 is coupled with an audible horn element 84 of the roller 10 of the kind generally known in the art. The horn switch 76 is directly coupled to the horn element 84. The horn switch 76, as previously indicated, is configured to sound the horn element 84 when depressed and to cease sounding of the horn when the operator releases the horn switch 76.

While each of the control elements or switches 64, 66, 68, and 74 is described as being in communication with the controller 78, which relays the signals from the switches 64, 66, 68, and 74 to the appropriate part of the roller 10, it is to be understood that one or more of the control elements may be configured to communicate directly with the part of the roller 10 it is configured to control such that the control assembly 26 may be entirely devoid of the controller 78. Also, the horn switch 76 is shown as being directly coupled to the horn element 84 and may alternatively be interconnected with the controller 78 for relaying communications between the horn switch 76 and the horn element 84. Of course, any number of combinations of switches relaying signals through the controller 78 or being coupled directly with the feature of the roller 10 it is configured to control is envisioned and understandably within the scope of the present invention.

It is understood the roller 10 employing the control lever 30 of the present invention may include one or more additional controls elsewhere on the roller 10. For instance, the roller 10 may include a number of advanced controls for controlling, e.g., spray volume of the spray assembly 44, on the dash thereof. The control lever 30 also may include additional control elements like those described herein for controlling any number of additional features of the roller 10 as may be readily appreciated. Moreover, the roller 10 may include duplicative control elements mounted, e.g., on the dash of the roller 10 to enable the operator to not only control the functions of the roller 10 on the control lever 30 but also via controls on the dash. For instance, the high and low vibration settings for the exciter assemblies 80 and 82 may be controlled at the dash instead of or in addition to at the control lever 30.

Although the best mode contemplated by the inventors of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the appended claims and other attachments.

I claim:

1. A vibratory roller comprising:

a chassis;

front and rear rotating drum assemblies supporting the chassis on a surface, wherein each of the front and rear drum assemblies includes an exciter assembly for imparting vibrations to the respective drum assembly;

an operator's seat supported on the chassis;

a control lever, located beside the operator's seat and operably coupled to the vibratory roller, for controlling forward and rearward movement of the vibratory roller, the control lever including an at least generally vertically extending support arm that is movable fore and aft relative to the operator's seat and a handle that extends from an upper end portion of the handle, the handle being shaped and sized for grasping by a seated operator so that the seated operator's thumb is received over an inboard end portion of the control lever while the seated operator's fingers are received over a top portion of the handle;

a first control element, located on the inboard end portion of the control lever, and accessible by the thumb of the seated operator when the operator is grasping the handle with the operator's fingers receive over the top portion of the handle, for turning the front and rear exciter assemblies on and off; and a second control element, located on the inboard end portion of the control lever, and accessible by the thumb of the seated operator when the operator is grasping the handle with the operator's fingers received over the top portion of the handle, for switching between activation of the front exciter assembly, the rear exciter assemblies, and both exciter assemblies.

2. The vibratory roller of claim 1, further comprising another control element located on the inboard end portion of the control lever and accessible by the thumb of the seated operator when the operator is grasping the handle with the operator's fingers received over the top portion of the handle, for switching at least one of the front and rear exciter assemblies between a high vibration setting and a low vibration setting.

3. The vibratory roller of claim 2, wherein the control lever has an inboard end surface, and wherein the first, second, and the another control element are each disposed on the inboard end surface of the control lever.

4. The vibratory roller of claim 3, wherein the second control element is disposed vertically between the first and another control element.

5. The vibratory roller of claim 1, further comprising a spray assembly operably supported on the chassis and configured to spray a fluid on at least one of the front and rear drum assemblies, and another control element, located on the inboard end portion of the control lever and accessible by the thumb of the seated operator when the operator is grasping the handle with the operator's fingers received over the top portion of the handle, for controlling the spray assembly.

6. The vibratory roller of claim 1, further comprising a horn operably supported on the chassis and configured to emit a warning sound, and another control element, located on the control lever, for selectively sounding the horn.

7. The vibratory roller of claim 1, wherein, the control lever has an inboard surface facing the operator's seat and an outboard surface facing away from the operator's seat, and wherein the first and second control elements are positioned on the inboard surface of the control lever.

8. The vibratory roller of claim 1, wherein the second control element is a toggle switch comprising front and rear toggle elements and is configured to be selectively depressible between a first position in which the front toggle element is depressed and only the front exciter assembly is activated, a second position in which the rear toggle element is depressed and only the rear exciter assembly is activated, and a third, intermediate position in which both the front and rear exciter assemblies are activated.

9. The vibratory roller of claim 1, wherein the control arm of the control lever has a stroke length of approximately twelve inches, and wherein the first and second control elements are accessible by the thumb of by the seated operator along the entire stroke length without the operator releasing the handle of the control lever with the operator's fingers.

10. The vibratory roller of claim 1, further comprising at least one additional control element, wherein the at least one additional control element is disposed on at least one of a front surface, a rear surface end, and an inboard surface of the control lever.

11. A vibratory roller comprising:

a chassis;

a front and a rear rotating drum assembly supporting the chassis on a surface, wherein each of the front and rear drum assemblies includes an exciter assembly, for imparting vibrations to the respective drum assembly;

an operator's seat supported on the chassis;

a spray assembly operably supported on the chassis and configured to spray a fluid on at least one of the front and rear drums assemblies;

a horn operably supported on the chassis and configured to emit a warning sound;

a control lever, located beside the operator's seat and operably coupled to the vibratory roller, for controlling forward and rearward movement, of the vibratory roller, the control lever including an at least generally vertically extending, support arm that is movable fore and aft relative to the operator's seat but which is restrained from lateral movement relative to the operator's seat and handle, the handle 1) being canted relative to a plane that laterally bisects the support arm, 2) having an inboard end counted to the support arm, and 3) having an outboard end, the handle being shaped and sized for grasping by a seated operator so that the seated operator's thumb is received over an inboard end portion of the control lever beneath an upper surface of the handle while the seated operator's fingers are received over an upper surface of the handle;

a first control element, located on the inboard end portion of control lever and accessible by the thumb of the seated operator when the operator is grasping the handle with the operator's fingers received over the upper surface of the handle, for turning the front and rear exciter assemblies on and off;

a second control element, located on the inboard end portion of control lever and accessible by the thumb of the seated operator when the operator grasping the handle with the operator's fingers received over the upper surface of the handle, for switching between activation of the front, rear, and both exciter assemblies, a third control element, located on the inboard end portion of the control lever and accessible by the thumb of the seated operator when the operator is grasping the handle with the operator's received over the upper surface of the handle, for switching any active exciter assemblies between high and low vibration;

a fourth control element, located on the inboard end portion the control lever and accessible by the thumb of the seated operator when the operator is grasping the handle with the operator's fingers received over the upper surface of the handle, for turning the fluid spray assembly on and off, and a fifth control element, located on the control lever, for sounding the horn.

12. The vibratory roller of claim 11, wherein the first, second, and third control elements are disposed on the inboard surface of the control lever.

13. The vibratory roller of claim 11, wherein the second control element a toggle switch comprising front and rear toggle elements configured to be selectively depressible between a first position in which the front toggle element is depressed and only the front exciter assembly is activated, a second position in which the rear toggle element is depressed and only the rear exciter assembly is activated, and a third, intermediate position in which both the front and rear exciter assemblies are activated.

14. The vibratory roller of claim 11, wherein the control lever has a fore and aft stroke length of approximately twelve inches, and wherein the first and second control elements are accessible by the thumb of by an operator along the entire stroke length without the operator releasing handle of the control lever.

15. The vibratory roller of claim 11, wherein the fourth control element is disposed on the front surface and the fifth control element is disposed on the rear surface.

16. A method of operating a vibratory roller comprising a chassis, front and rear rotating drum assemblies supporting the chassis on a surface, and an operator's seat supported on the chassis, the method comprising the steps of:

driving front and rear rotating drum assemblies to rotate thereby to propel the roller;

moving a control lever, positioned beside the operator's seat, between a forward-most position and a rearward-most position defining a stroke length, the moving step being performed by a seated operator and including moving the control lever fore and aft relative to the chassis while grasping a handle of the control lever with the operator's fingers wrapping over a top of the handle and the operator's thumb resting on an end portion of the control lever;

using the seated operator's thumb while grasping the handle of the control lever with the operator's fingers wrapping over the top of the handle, actuating a first control element, located on the end portion of the control lever, to activate or deactivate at least one of front and rear exciter assemblies, the front and rear exciter assemblies being associated with the front and rear drum assemblies, respectively; and using the seated operator's thumb while grasping the handle of the control lever with the operator's fingers wrapping over the top of the handle, actuating a second control element, located on the end portion of the control lever, to select at least one of the front and rear exciter assemblies to be activated by the first control element.

17. The method of claim 16, wherein the actuating step while the seated operator is grasping the control lever at any location within the stroke length of the control lever.

18. The method of claim 16, wherein the second control element is a toggle switch comprising front and rear toggle elements and further comprising the steps of depressing the front toggle element to activate only the front exciter assembly, depressing the rear toggle element to activate only the rear exciter assembly, and positioning the toggle switch in an intermediate position to activate both the front and rear exciter assemblies.

19. The method of claim 16, further comprising actuating at least one additional control element on the to at least one of 1) switch between high and low vibration of at least one of the front and rear exciter assemblies, 2) activate a spray assembly of the roller, and 3) sound a horn of the roller.

* * * * *

UNITED STATES PATENT AND TRADEMARK OFFICE

CERTIFICATE OF CORRECTION

PATENT NO. : 8,770,887 B1
APPLICATION NO. : 13/745181
DATED : July 8, 2014
INVENTOR(S) : Geier It is certified that error appears in the above-identified patent and that said Letters Patent is hereby corrected as shown below:

IN THE CLAIMS

| | |
|---|---|
| CLAIM 1, Line 23<br>Col. 11, Line 1 | Replace "receive" with "received" |
| CLAIM 11, Line 15<br>Col. 12, Line 15 | Remove the "," between "movement" and "of" |
| CLAIM 11, Line 17<br>Col. 12, Line 17 | Remove the "," between "extending" and "support" |
| CLAIM 11, Line 19<br>Col. 12, Line 19 | Add "a" after "and" |
| CLAIM 11, Line 37<br>Col. 12, Line 37 | Add "is" between "operator" and "grasping" |

Signed and Sealed this
Second Day of September, 2014

Michelle K. Lee

Michelle K. Lee
*Deputy Director of the United States Patent and Trademark Office*